US008197173B2

(12) United States Patent
Pessach et al.

(10) Patent No.: US 8,197,173 B2
(45) Date of Patent: Jun. 12, 2012

(54) CONCERTINA-WIRE BARRIER RAPID DEPLOYMENT APPARATUS AND METHOD

(76) Inventors: Ofir Pessach, Gderot (IL); Ran Pessach, Omer (IL)

( * ) Notice: Subject to any disclaimer, the term of this patent is extended or adjusted under 35 U.S.C. 154(b) by 813 days.

(21) Appl. No.: 12/028,809

(22) Filed: Feb. 10, 2008

(65) Prior Publication Data

US 2009/0200415 A1 Aug. 13, 2009

(51) Int. Cl.
*B65F 9/00* (2006.01)

(52) U.S. Cl. ..... 414/337

(58) Field of Classification Search ..... None
See application file for complete search history.

(56) References Cited

U.S. PATENT DOCUMENTS 3,070,946 A * 1/1963 Kirsch et al. ..... 57/1 R
3,463,455 A * 8/1969 Meckel ..... 256/8
4,484,729 A * 11/1984 Mainiero et al. ..... 256/1
4,503,423 A * 3/1985 Mainiero et al. ..... 340/552
6,682,279 B2 1/2004 Pessach et al.
7,290,756 B2 11/2007 Pavlov

* cited by examiner

*Primary Examiner* — Saul Rodriguez
*Assistant Examiner* — Willie Berry, Jr.
(74) *Attorney, Agent, or Firm* — Mark M. Friedman

(57) ABSTRACT

Methods and devices for loading, deploying, and receiving concertina-wire barriers along paths with varying travel or paths located at a distance to the access track of a transport vehicle. The first method includes loading a concertina-wire coil arrangement directly into carry tines and adjusting the tine tilt during deployment to reflect the changing gradient. An anchored portion of the wire stretches each coil longitudinally into its operative configuration and position as the transport vehicle advances. A second method involves a generally analogous process in order to deploy the barrier at distance from the access route. Retrieval for both methods is accomplished by inserting the carry tines in the space circumscribed by the deployed coils so that as the transport vehicle advances the coil arrangement is removed from its deployment location and pressed together onto the tines thereby being disposed for the next deployment.

5 Claims, 11 Drawing Sheets

CONCERTINA-WIRE BARRIER RAPID DEPLOYMENT APPARATUS AND METHOD

FIELD AND BACKGROUND OF THE INVENTION

The present invention relates to concertina-wire barriers and, in particular, it concerns their deployment in locations with a changing travel gradient and in locations removed from a deployment vehicle's line of travel.

U.S. Pat. No. 6,682,279 discloses a vehicular deployment method for concertina-wire barriers along a path of travel by loading a compressed barrier onto a vehicular deployment rack, anchoring a portion of the wire to a substrate and driving along the deployment path so that the anchored concertina wire applies a tension to the compacted concertina-wire coil arrangement and stretches it longitudinally onto the deployment path. However, there are settings that pose problems for such a deployment method. During uphill deployments the coil arrangement tends to slide off the rack prematurely. Proposed deployments along routes difficult for vehicles to negotiate or along paths set apart from the existing vehicle access track render the above-mentioned method almost useless. An additional shortcoming is its inability to load the coils onto the deployment rack. U.S. Pat. No. 7,290,756 discloses a method and device employing a magazine that deploys the concertina-wire coil arrangements while being towed by a vehicle. Several shortcomings emerge when deploying the barrier over distance requiring many lengths of concertina-wire coil arrangements. Since the deployment magazine is unable to contain all the required coil arrangements together, each additional coil arrangement must either be transported to the deployment location and then loaded onto the deployment magazine, or pre-loaded onto separate deployment magazines and then transported to the deployment location. Both options suffer from shortcomings. The first option requires additional lift equipment and manpower, while the second option requires a supply of deployment magazines, transport to the deployment location, and return transport to a storage area. On site, the latter method necessitates an additional task of tracking the unloaded magazines. Upon retrieval, another problem emerges; since the deployment magazines are not configured to collect deployed concertina-coil arrangements they must be collected manually. These shortcomings exacerbate expenses, complicate deployment logistics and diminish deployment effectiveness.

There is therefore a need for a concertina-wire barrier deployment method enabling loading, deployment, and retrieval via a single vehicle. The method must be capable of efficiently deploying a number of coil arrangements along uphill travel gradients or along paths removed from available transport routes.

SUMMARY OF THE INVENTION

The present invention is method and device for loading, deploying, and retrieving concertina-wire barrier along paths of varying gradients or along paths set apart from available vehicle access routes via a single vehicle.

According to the teachings of the present invention there is provided a method for rapid deployment of concertina-wire barriers along varying travel gradients comprising: (a) providing a compacted concertina-wire coil arrangement and a carry structure including a support structure, said support structure supporting said concertina-wire coil arrangement; (b) moving said carry structure along the varying travel gradient so as to progressively deploy the concertina wire from said compacted concertina-wire coil arrangement as a barrier; and (c) adjusting a tilt of said support structure while said carry structure moves along the varying travel gradient so that said supported, compacted concertina-wire coil arrangement is gravitationally biased not to slide off said support structure thereby establishing a required deployment tension.

According to a further feature of the present invention, the support structure is implemented as a structure possessing at least one tine.

According to a further feature of the present invention, the support structure is implemented as a platform.

According to a further feature of the present invention, the changing travel gradient includes an uphill slope.

According to a further feature of the present invention, the adjusting is performed by actuating a mechanism so as to vary an inclination of said support structure relative to a vehicle carrying said carry structure, and wherein said mechanism varies said inclination though an angular range of at least 45 degrees relative to said vehicle.

There is also provided according to the teachings of the present invention, a rapid-deployment device for concertina-wire barriers comprising: (a) at least one tine disposed on a first tier and at least one additional tine disposed on an at least one additional tier, said tines further disposed so as to support a compacted concertina-wire coil arrangement during transport; (b) a vehicular connect arrangement including an adjustable vehicular-hitch arrangement and a tine carrying structure, said tine carrying structure adapted to connect to said adjustable vehicular-hitch arrangement and being configured to render an adjustable vehicular-hitch arrangement action-of-adjustment into a corresponding angular adjustment of said tine.

According to a further feature of the present invention, the at least one said tine disposed on a first tier is implemented as three tines.

According to a further feature of the present invention, the at least one tine disposed on a first tier and at least one additional tine disposed on an at least one additional tier is rigidly connected to said tine carrying structure.

According to a further feature of the present invention, a control mechanism including a level sensor operatively coupled to said adjustable vehicular-hitch arrangement, said control mechanism being operative to maintain a predetermined tilt of said tine as travel gradient changes.

There is also provided according to the teachings of the present invention, a rapid-deployment rack for concertina-wire barriers comprising: (a) a tine carrying structure adapted to connect to an adjustable-tilt, vehicular-hitch structure; (b) a tine carrying structure adapted to connect to an adjustable-tilt, vehicular-hitch structure.

According to a further feature of the present invention, the at least one said tine disposed on a first tier is implemented as three tines.

There is also provided according to the teachings of the present invention, a method for rapid deployment of a concertina-wire barrier removed from a transport vehicle comprising: (a) providing a vehicle transporting a support structure at a distance from its own path of travel, said support structure supporting a compacted concertina-wire coil arrangement; (b) restraining at least a portion of said compacted concertina-wire which has been removed from said coil arrangement; and (c) transporting said support structure supporting said compacted concertina-wire coil arrangement so that said concertina-wire is pulled off said support structure while said carry structure and said supported compacted concertina-wire coil arrangement are transported along a path of deployment at a distance from the path the path of travel of said transport vehicle.

According to a further feature of the present invention, the transporting is performed by advancing said vehicle along its own line of travel, thereby deploying the concertina wire barrier at a distance from the vehicle's line of travel.

According to a further feature of the present invention, the transport vehicle is implemented as a mobile crane.

According to a further feature of the present invention, the transport vehicle is implemented as a helicopter.

According to a further feature of the present invention, the transport vehicle is implemented as a structure possessing at least one tine.

According to a further feature of the present invention, the transport vehicle is implemented as a platform.

There is also provided according to the teachings of the present invention, a rack for rapid deployment of a concertina-wire barrier from a transport vehicle adapted to support a load hanging freely comprising: (a) a tine carrying structure adapted to dangle from said transport vehicle; (b) at least one tine disposed on a first tier and at least one additional tine disposed on at least one additional tier on said tine carrying structure, said tines further disposed so as to support a compacted concertina-wire coil arrangement during transport and to gravitationally bias said compacted concertina-wire coil arrangement from sliding off said tine and to allow said concertina-wire to be pulled off said tine at a desired deployment tension by a portion of said concertina-wire which has been removed from said tine and has been retained.

According to a further feature of the present invention, the transport vehicle adapted to support a load hanging freely is implemented at a distance from its own travel route.

There is also provided according to the teachings of the present invention, a device for rapid, removed deployment of a concertina-wire barrier from a transport vehicle adapted to transport a load at a distance from its own travel route comprising: (a) at least one tine disposed on a first tier and at least one additional tine disposed on an at least one additional tier, said tines further disposed so as to support a compacted concertina-wire coil arrangement during transport, said tines being tilted so as to gravitationally bias said compacted concertina-wire coil arrangement from sliding off said tines and to allow said coil arrangement to be pulled off said tine at a desired deployment tension by a portion of said concertina-wire which has been removed from said tines and has been retained; (b) an adaptation structure including an adjustable vehicular-hitch structure and a tine carrying structure, said adjustable vehicular-hitch structure being configured to transport said tine carrying structure, said tine carrying structure being adapted to connect to said adjustable vehicular-hitch structure and further configured to render an adjustable vehicular-hitch structure action-of-adjustment into a corresponding angular adjustment of said tines.

According to a farther feature of the present invention, the tine carrying structure is implemented as a free hanging support structure so as to gravitationally maintain a predetermined optimal tilt of said tines.

There is also provided according to the teachings of the present invention, a method for loading and deploying concertina-wire barriers comprising: (a) providing a compacted concertina-wire coil arrangement and a tine structure; (b) inserting said tine structure into space circumscribed by said concertina-wire, (c) lifting tine structure so that said compacted concertina-wire coil arrangement is hanging from the tine structure; (d) moving said tine structure and said hanging concertina-wire coil arrangement along an intended deployment path so as to progressively deploy the concertina wire from said compacted concertina-wire coil arrangement as a barrier.

According to a further feature of the present invention, further comprising adjusting a tilt of said tine structure while moving along a varying travel gradient so that said hanging concertina-wire coil arrangement is gravitationally biased not to slide off said tine structure thereby establishing a required deployment tension.

According to a further feature of the present invention, the adjusting is performed by actuating a mechanism so as to vary an inclination of said tine structure relative to a vehicle carrying said tine structure, and wherein said mechanism varies said inclination though an angular range of at least 45 degrees relative to said vehicle.

According to a further feature of the present invention comprising; (a) inserting said tine structure into space circumscribed by said deployed concertina-wire; (b) advancing said tine structure through a space circumscribed by said deployed concertina-wire so that said coil arrangement is progressively removed from its said deployment location and compacted into its pre-deployment state on said tine structure.

There is also provided according to the teachings of the present invention a method for retrieving deployed concertina-wire barriers comprising: (a) providing a tine structure including at least one tine configured for insertion into a space circumscribed by a concertina-wire coil, said tine structure being disposed in a deployment configuration with said at least one tine at a first angle with an upward inclination towards the tip of said at least one tine; (b) redeploying said tine structure in a retrieval configuration with said at least one tine at a second angle with a downward inclination towards the tip of said at least one tine; and (c) advancing said tine structure through a space circumscribed by a deployed concertina-wire coil such that said deployed concertina-wire coil is successively lifted and collected onto said tine structure as said tine structure advances.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is method and a device for the loading, rapid deployment, and retrieval of concertina-wire barriers along varying travel gradients and along paths removed from transport routes.

The principles, method and operation of the concertina-wire barrier deployment according to the present invention may be better understood with reference to the drawings, the accompanying description, and the following term usages throughout this document. The term "tine" refers to a primarily prong-like structure. Such structures possessing slight curvatures, bends, or textured surfaces are all included within the scope of the term "tine". The terms "tilt", "slope", "inclination", or "angle", refer to such entities in relation to the transport vehicle unless otherwise noted. The term "coil" refers to any unit formed from left or right hand wire helices or a combination thereof or any other arrangement of coils or loops of wire that provide the functionality associated a concertina-wire coil. A barrier formed from one or more such coil units is referred to as a "coil arrangement". The "wire" referred to may be barbed wire, razor wire or any other elongated flexible element effective for forming a barrier.

Figure 1:
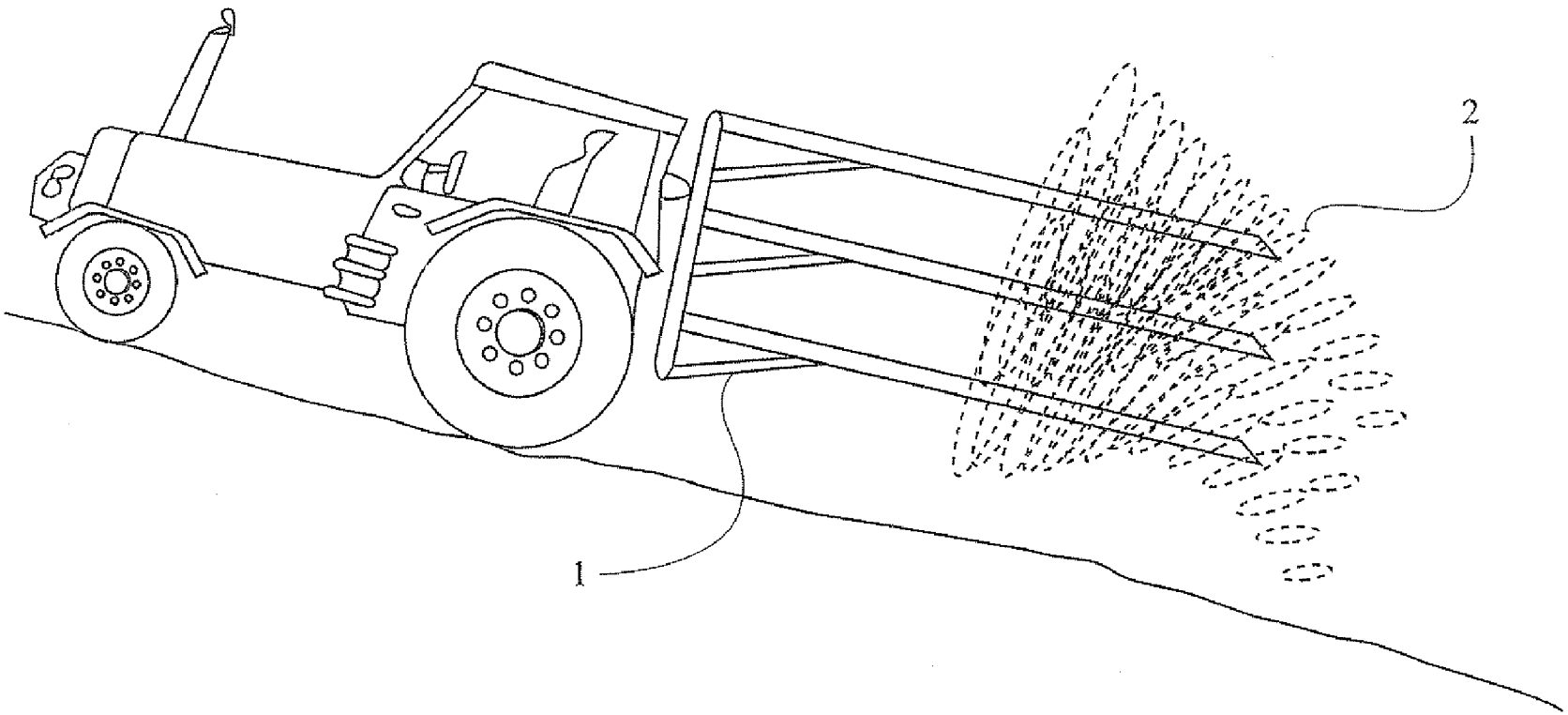
FIG. 1 depicts an unsuccessful uphill deployment in which the concertina-wire coil arrangements slide of the deployment tines prematurely.
Figure 2:
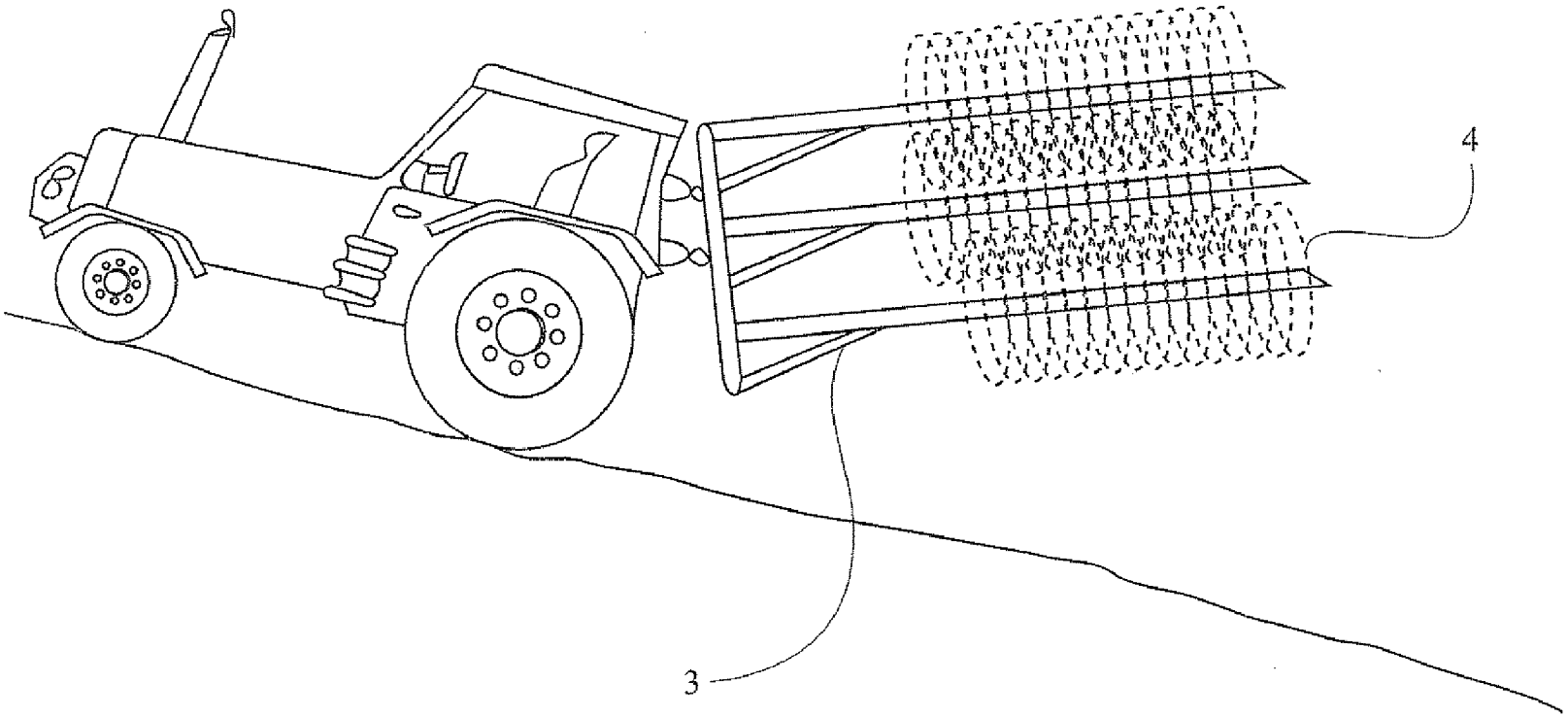
FIG. 2 depicts a first stage of a successful uphill deployment in which the concertina-wire coil arrangements remain on the deployment tines.

As mentioned above, known deployment methods for concertina-wire barriers in many commonly encountered scenarios do not provide the needed effective deployment. For example, during uphill transport as illustrated in FIG. 1, the uphill climb slope causes the deployment rack tines 1 to incline downwards, thereby failing to prevent the compacted concertina-wire from sliding off the deployment tines 2, or at least deploying under less-than-optimum tension. The deployment process includes retaining a portion of each concertina-wire coil so that each one applies a tension to the remaining compacted coil as the transport vehicle advances along the deployment route. The applied tension then stretches each coil longitudinally into its deployed configuration and the retained concertina-wires collectively pull the coil arrangement off the deployment rack tines 1 onto the deployment path. This deployment tension exacerbates the tendency to prematurely slide off the tines 1 prior to their achieving the full longitudinal expansion needed cover the length of the proposed deployment path in its most operative configuration 2. FIG. 2 depicts an uphill deployment in which the deployment rack tines 3 are tilted at the angle needed to prevent the coil arrangement 4 slippage caused by the uphill slope combined with the applied deployment tension. The barrier is most effectively deployed when deployment tines 3 are disposed within an optimal range that gravitationally biases the compacted coil arrangement 4 from sliding off the deployment tines 3 prematurely;

1. defines the deployment tension needed to fully stretch the compacted coils into their fully operative extended configuration; and
2. allows the extended coil arrangement to be pulled off the deployment tines onto the deployment path.

Therefore, a steep travel gradient requires the carry tines to be sharply inclined, a moderate gradient requires them to be moderately inclined; a level path of travel requires them to be mildly inclined. A changing travel gradient requires an adjustable tine tilt that reflects the changes in gradient.

Figure 3:
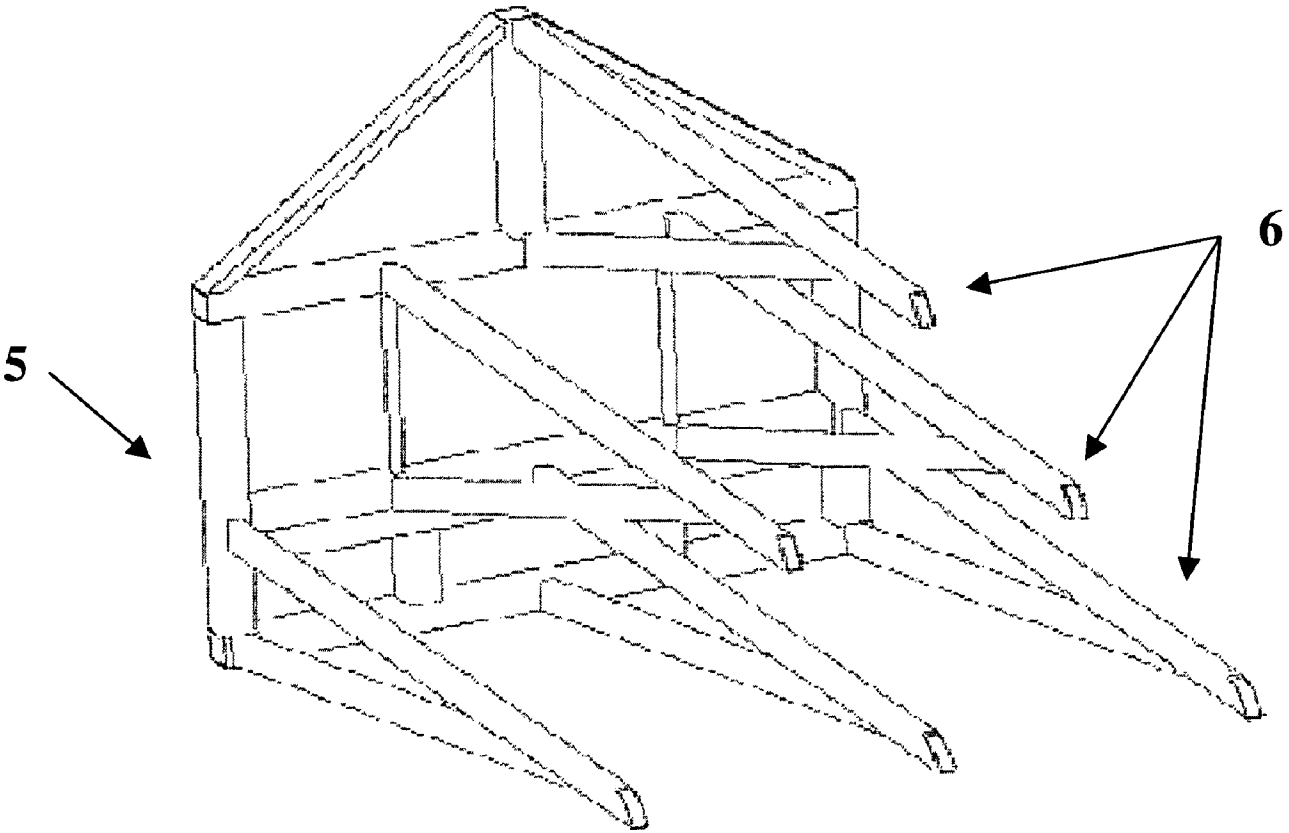
FIG. 3 is an isometric view of a concertina-wire barrier deployment rack.
Figure 4:
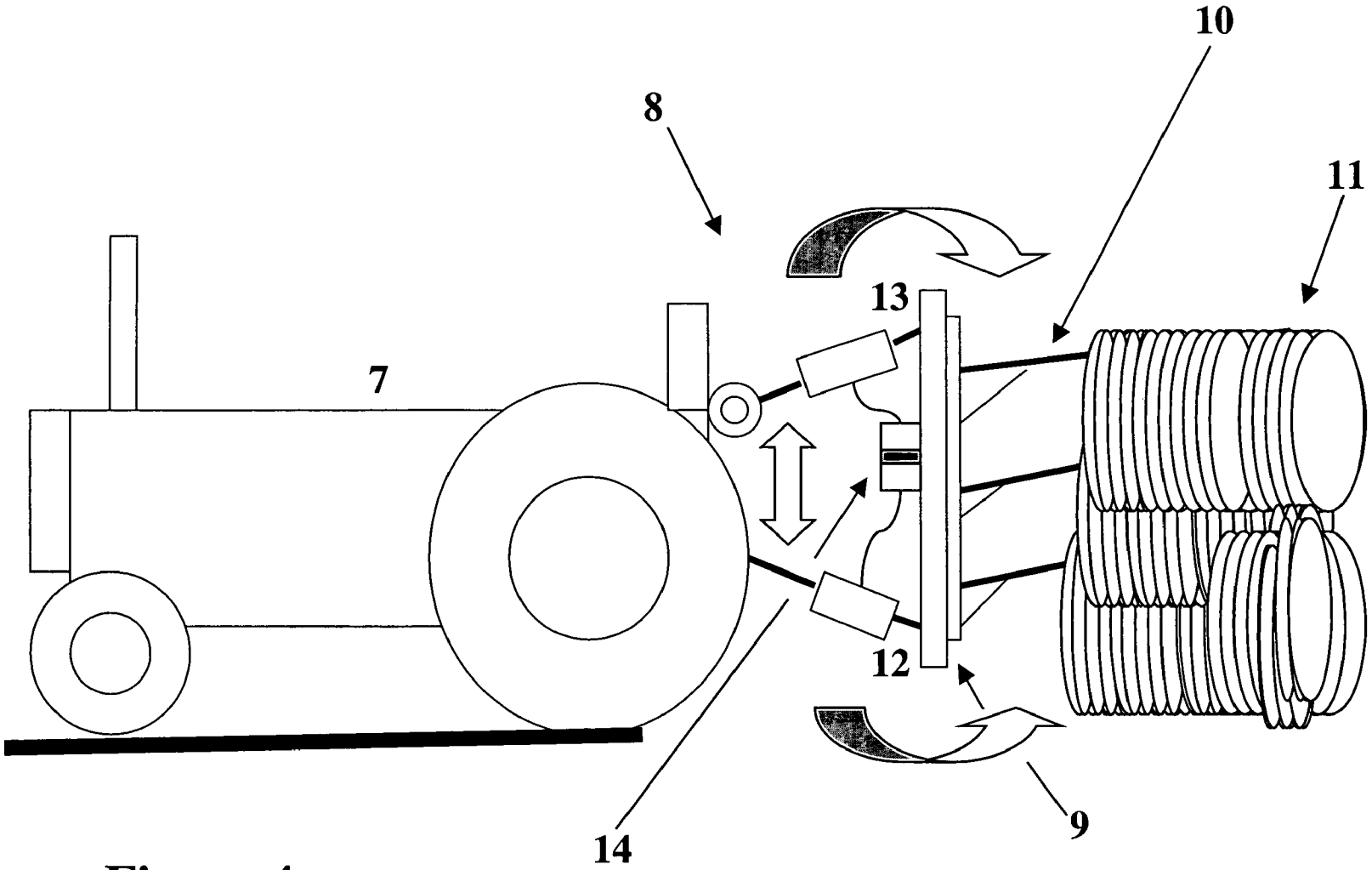
FIG. 4 is a schematic side view of a system for implementing the concertina-wire barrier active-tilt, rapid deployment method of FIG. 5.

An active-tilt concertina-wire deployment rack as illustrated in FIG. 3 includes a carry structure 5 and, in a first preferred embodiment, rigidly connected deployment tines 6 disposed on at least two different tiers for conveying a compacted concertina coil arrangement throughout the deployment. A transport vehicle, for example a tractor 15 as illustrated in FIG. 4, is fitted with a vehicular-lift accessory 8 carrying the rapid-deployment rack 9. The rack 9 is adapted to attach to the lift accessory 9. In this non-limiting embodiment, the lift mechanism 9 supplies the needed deployment tine tilt through the lift elements 12 & 13.

Figure 5:
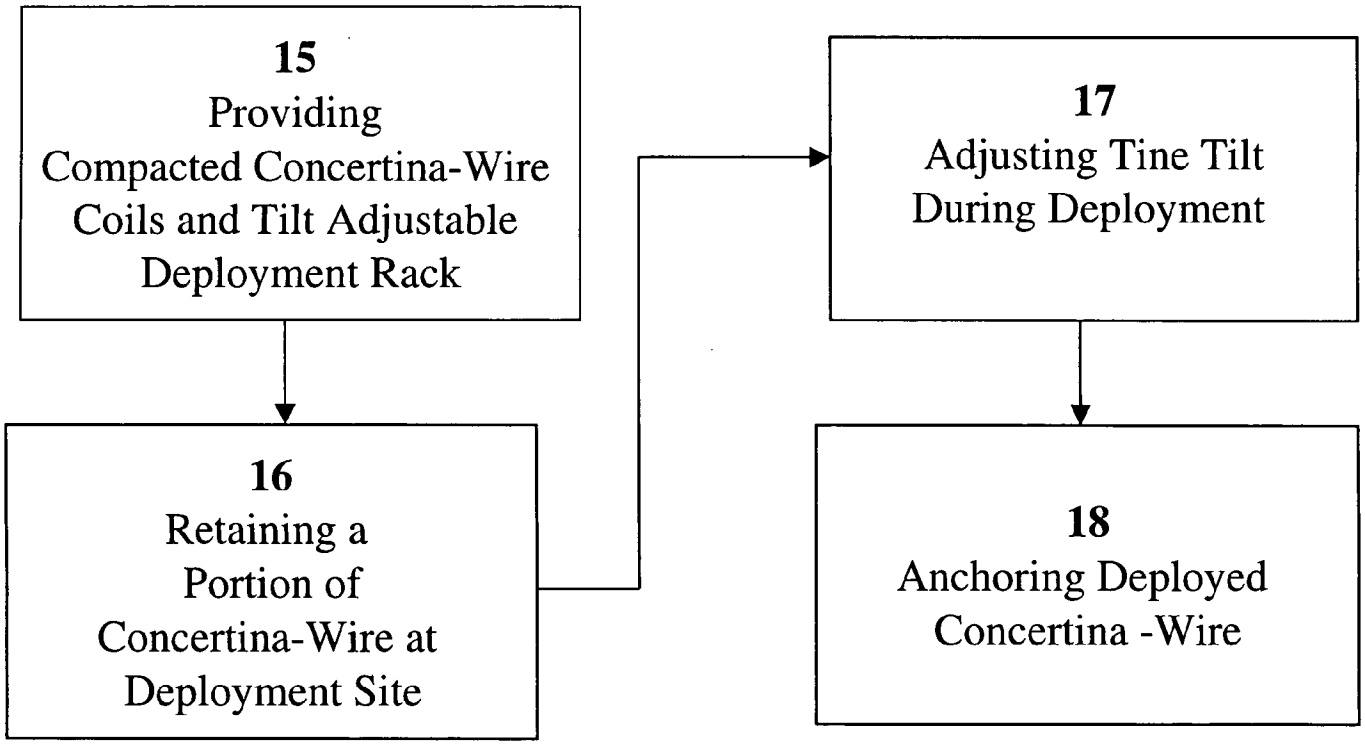
FIG. 5 is a flowchart for a concertina-wire barrier rapid deployment method along a varying travel gradient.

Referring now to FIGS. 4 and 5, after the compacted concertina-wire coil arrangement 11 has been loaded onto the deployment tines 10 configured as shown in FIG. 4 deployment commences at the deployment path by removing a portion of the concertina-wire from each coil and anchoring them or at least retaining them so that they will apply a tension to the compacted coils remaining on the deployment tines as the transport vehicle advances along the deployment path 16. During deployment the tines 10 are generally inclined upwards towards their tip as illustrated in FIG. 4. As the transport vehicle encounters changes in the travel gradient the driver adjusts the lift elements 12 & 13 to ensure the deployment tines 10 are disposed within the optimal tilt range providing the gravitational bias preventing the coil arrangement from sliding off the tines while still enabling the deployment tension to stretch the compacted coils longitudinally into their operative configuration onto the deployment path 17. The barrier is then anchored into place 18.

Figure 6:
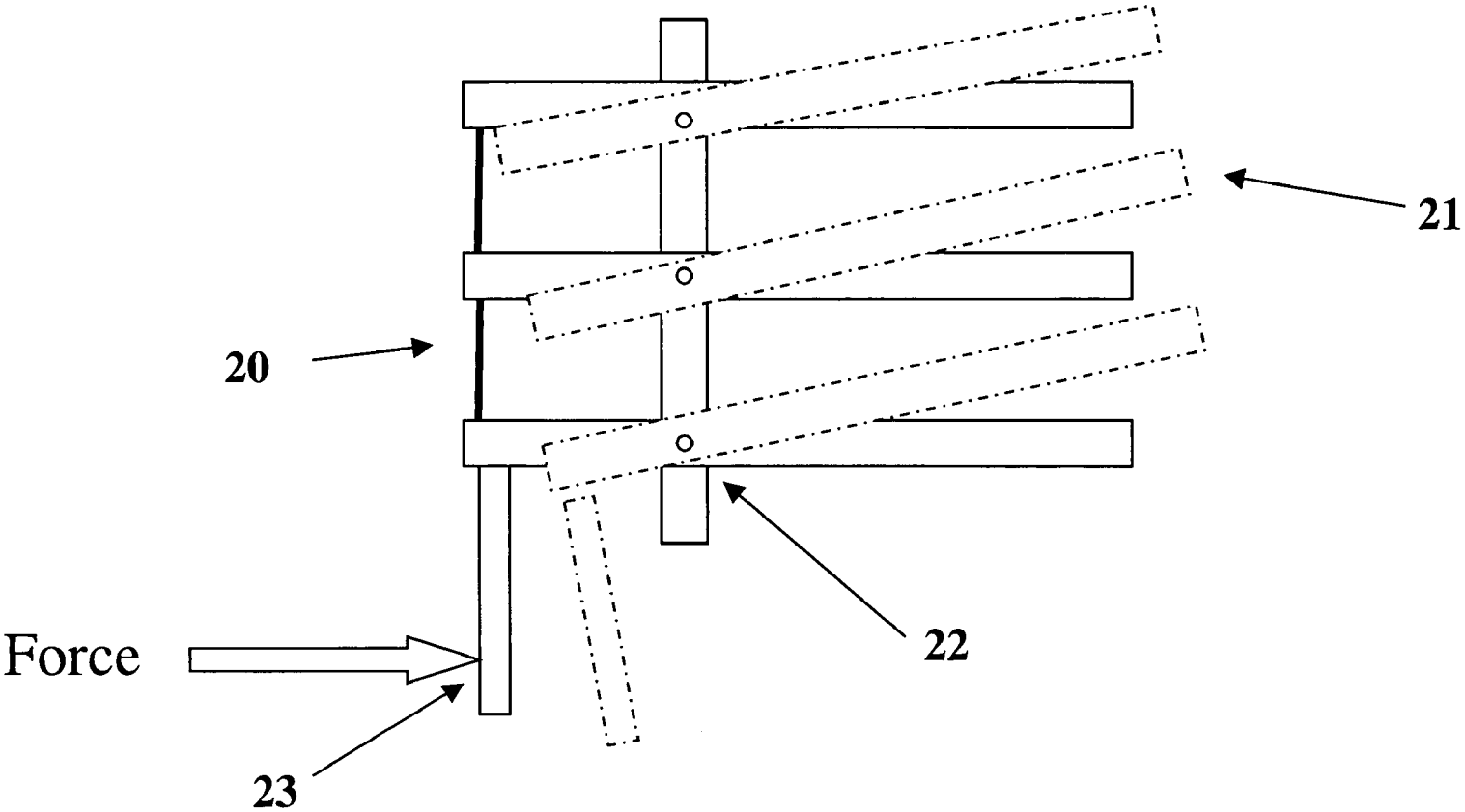
FIG. 6 is a schematic side view of a pivotal tine embodiment of a concertina-wire barrier deployment rack implemented with tine pivot action.

It should be noted that the above-mentioned embodiment employs a deployment rack 9 possessing rigidly connected tines 10 whose tilt is adjusted by changing the tilt of the entire rack as shown in FIG. 4. An alternate, but generally analogous embodiment, depicted in FIG. 6, possesses pivotally mounted tines 22 connected together via a connecting rod 20 so that the tines rotate in unison 21. Such an embodiment negates the need for a lift mechanism to provide the tine tilt; rather a hydraulic arm, a screw mechanism, or any assembly configured to apply a force to the rotate lever 23 may provide the tine adjustment needed to ensure proper transport and delivery.

The tine tilt may be regulated manually or automatically. FIG. 4 further depicts an automated tilt provision including a level sensor and tilt actuator 14 configured to activate the lift elements 12 & 13, thereby setting the required tine tilt during transport and deployment.

Figure 7:
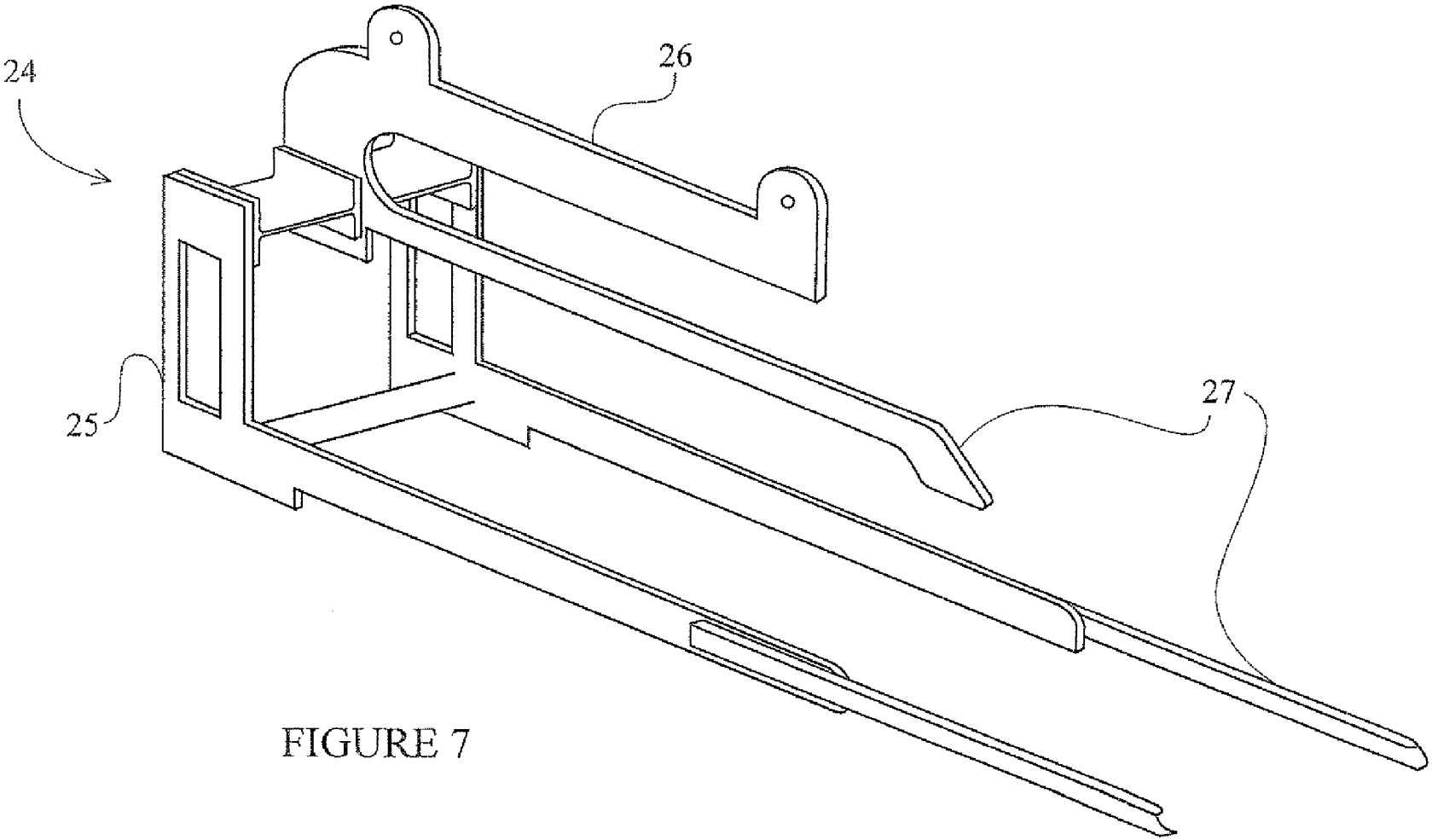
FIG. 7 is an isometric view of a concertina-wire barrier rapid and removed deployment rack adapted for suspension.
Figure 8:
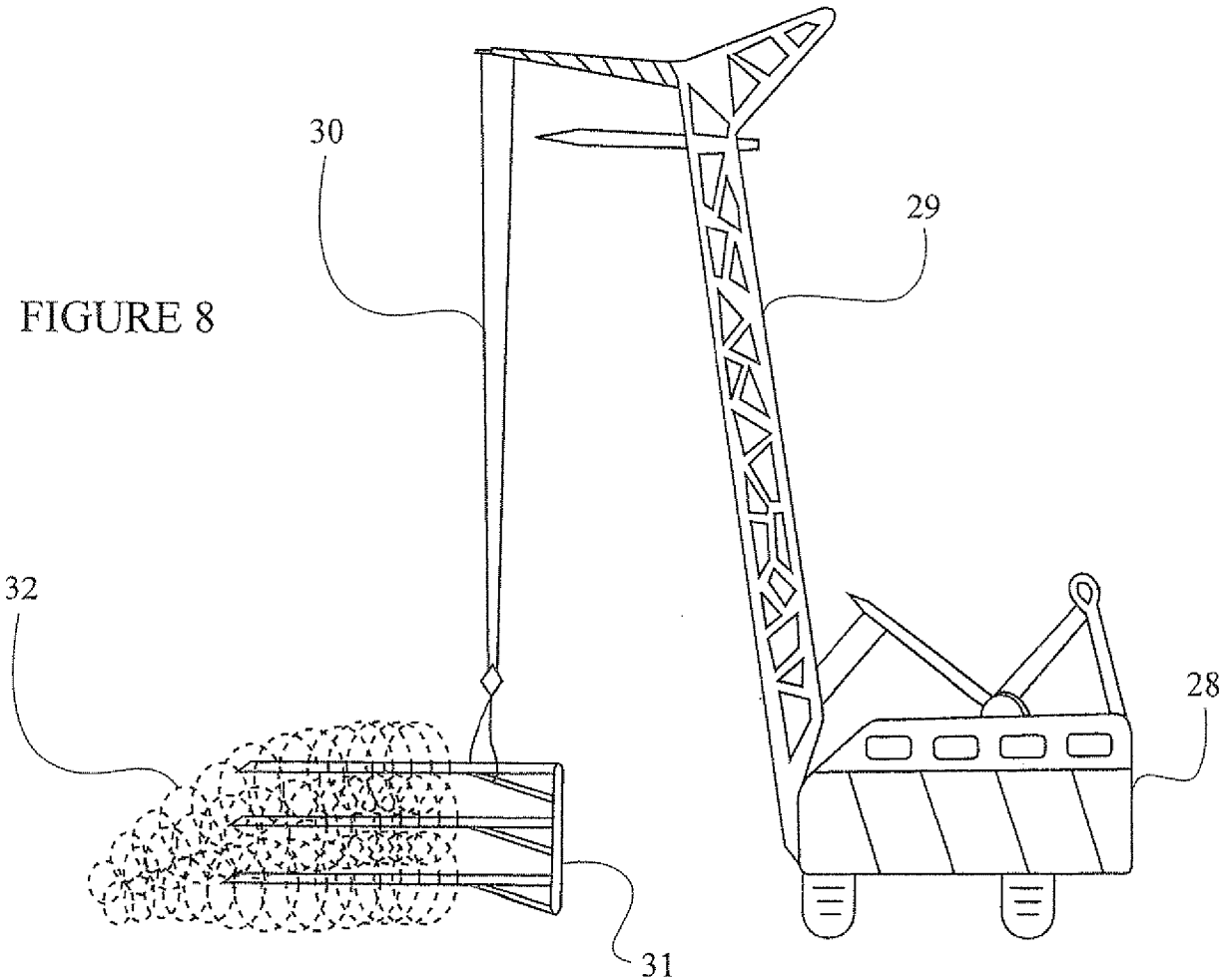
FIG. 8 is a schematic front view of a suspension embodiment of a system for implementing the concertina-wire barrier rapid and removed deployment method of FIG. 9.

As mentioned above, deployment paths set apart from an access route or too rugged for conventional transport vehicles to negotiate require alternative deployment methods. The present invention addresses this need. FIG. 7 illustrates a deployment rack 24 generally analogous to the deployment rack shown in FIG. 3, with two differences. The current deployment rack 24 possesses a suspension element 26 enabling the deployment rack to be hung from a transport vehicle. The second difference is that deployment tines 27 are disposed on the support structure 25 so to gravitationally bias the coil arrangement from falling off the tines 27 while also defining a deployment tension that stretches the coils longitudinally into their most operative configuration. FIG. 8 depicts a deployment system in which the above-mentioned deployment rack 31 is suspended from a mobile crane 28.

Figure 9:
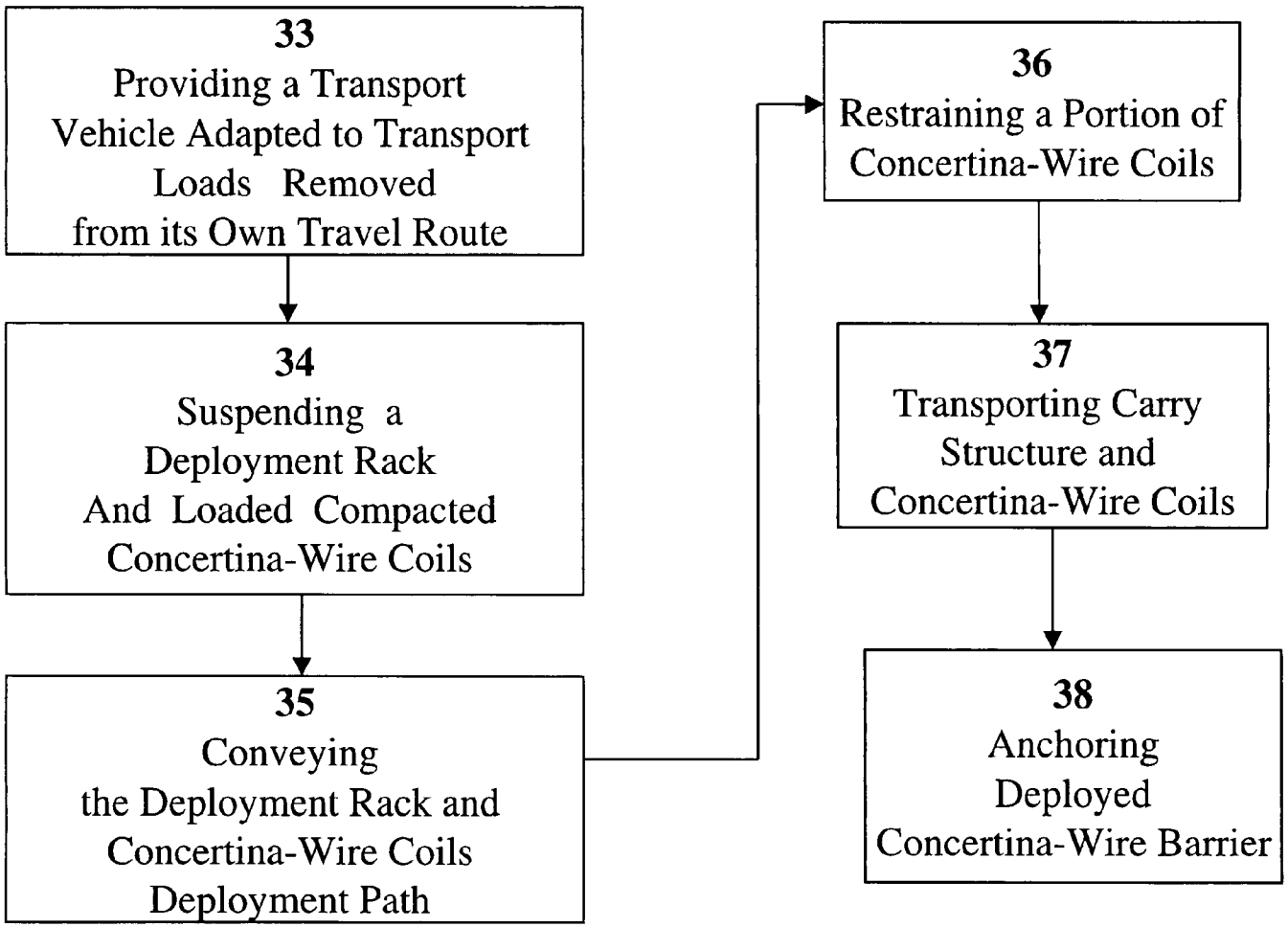
FIG. 9 is a flowchart of a rapid-deployment method of a concertina-wire barrier along a path removed from the line of travel of a deployment vehicle.

Referring now to FIGS. 8 and 9, after the deployment rack 31 has been suspended from the crane boom 29 and the compacted concertina-wire coil arrangement loaded on the deployment tines 33 & 34, the mobile crane conveys the coil arrangement to the deployment path where the deployment rack and the loaded coil arrangement are suspended above the path 35. A portion of the concertina-wire is removed from each coil and anchored or at least restrained 36 so that that each wire will apply a tension to the corresponding compacted coil remaining on the deployment rack 31 as the mobile crane 28 advances along its line of travel. The crane 28 then proceeds along its path of travel causing the anchored wire to stretch the wire longitudinally into its extended operative configuration onto the deployment path 37. The barrier is then anchored 38 along the deployment path. As mentioned above, the tine is rigidly disposed at an angle that gravitationally biases the coil arrangement from falling off the tines 27 while also defining a deployment tension that stretches each coil longitudinally into its most operative configuration. The constant gravitational tug preserves the deployment rack 31 orientation defined at the time the rack was suspended. There is, therefore, no further requirement to adjust the tine tilt to match the changing deployment gradient as described in the previous embodiment and illustrated in FIG. 4.

Figure 10:
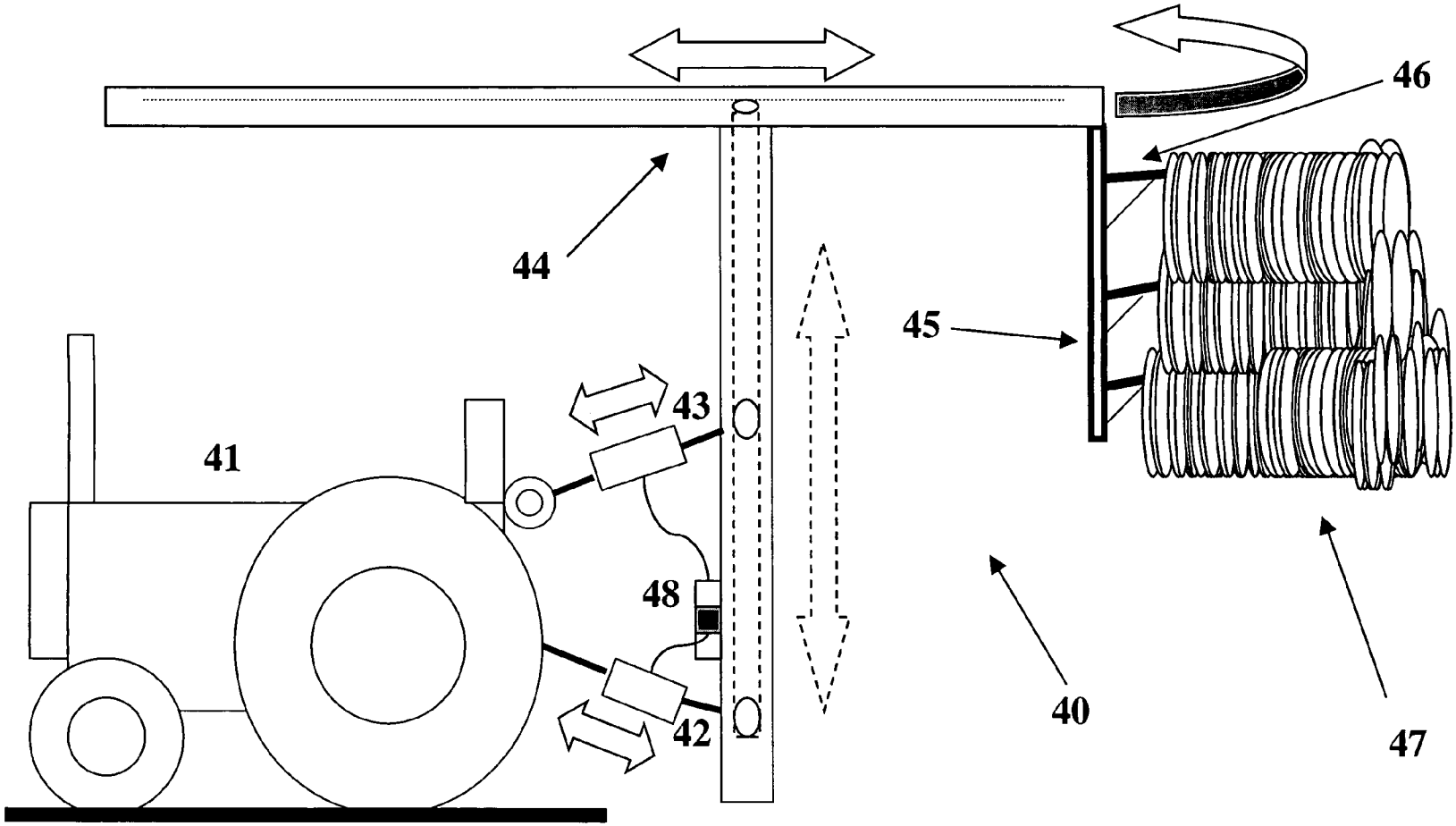
FIG. 10 depicts a non-suspension implementation for rapid and removed deployment of concertina-wire barrier.

It should be noted that alternative transport vehicles capable of transporting suspended loads are also effective deployment vehicles. A few non-limiting examples include helicopters, loaders and tractors fitted with the appropriate hardware enabling suspension at a distance from the travel path. An additional non-limiting embodiment combines both the removed deployment and active gradient-responsive tilt features. By way of example, FIG. 10 depicts a vehicular hitch mechanism 1, connected to a tractor 9. The vehicular lift mechanism 1 includes lift elements 2 & 3 to provide the tilt needed to gravitationally bias the compacted concertina-wire coil arrangement 8 from sliding off the tines 7 during transport and to define the deployment tensions needed to adequately stretch the compacted coils into their deployed configurations. The lift mechanism includes an extendable arm 4 through which it conveys the compacted coil arrangement 8 to the removed deployment site. This deployment method is generally analogous to the removed deployment method taught above. Whereas the removed-deployment embodiment previously taught provides a deployment rack with the tines disposed at an optimal tilt maintained through a suspension configuration, the current embodiment provides for optimal tilt through an adjustable tilt mechanism analogous to the gradient responsive embodiment taught above.

It should be noted that the tilt feature is responsive to the changing gradient encountered by the transport vehicle and not the changing gradient of the removed deployment location, since this slope effects the tine tilt. The tine tilt may be regulated manually or automatically. FIG. 10 further depicts an automated tilt provision including a level sensor and tilt actuator 10 configured to activate the lift elements 2 & 3 thereby setting the required tine tilt during transport and deployment.

The remote deployment method and devices taught herewith provide for deployment along paths horizontally or vertically distant from the access route. Those distances may vary between a few millimeters or tens of meters, depending on the span of the crane boom 29 employed. A deployment at any distance removed from an access route is within the scope of the current invention.

It should be noted that a variant of each of the described embodiments employs a platform in place of the above-mentioned tines. The platform may be implemented in a variety of forms, all of which provide support to the concertina-wire coil arrangement. A number of non-limiting examples include a flat horizontal surface, a flat horizontal surface with attachable walls, a flat surface with walls curving upwards at a point corresponding to the cumulative width of the bottom layer of coils, or a number of interconnected parallel semi-circular channels disposed so that each bottom-tier coil is seated within a separate channel. These elements may be integrally connected or non-integrally connected to facilitate the addition or removal of seating elements to match the number of bottom level coils to be deployed.

It should be further noted that both rear-end and front-end vehicular hitch accessories fall within the scope of the current invention.

Turning now to loading features, as mentioned above, current loading methods require either the assistance of lift equipment or carry accessories like pallets. The current invention discloses a method and device for performing these functions without the assistance of such agents. FIG. 4 illustrates a deployment vehicle 7 fitted with a vehicular hitch lift mechanism 8 and concertina-wire barrier deployment rack 9 capable of loading compacted concertina-wire coils 11 directly on to the carry tines 10. The deployment vehicle 7 inserts the carry tines 10 into the space defined by the coils 11 and lifts the tines 7 via the lift elements 12 and 13 thereby disposing the coil 11 for deployment. At the deployment path the coil arrangement 11 is deployed as will be later described. Where multiple lengths of concertina-wire coil arrangements are to be deployed, the loading is repeated in the manner described, thus negating the need for multiple carry pallets or magazines.

Figure 11:
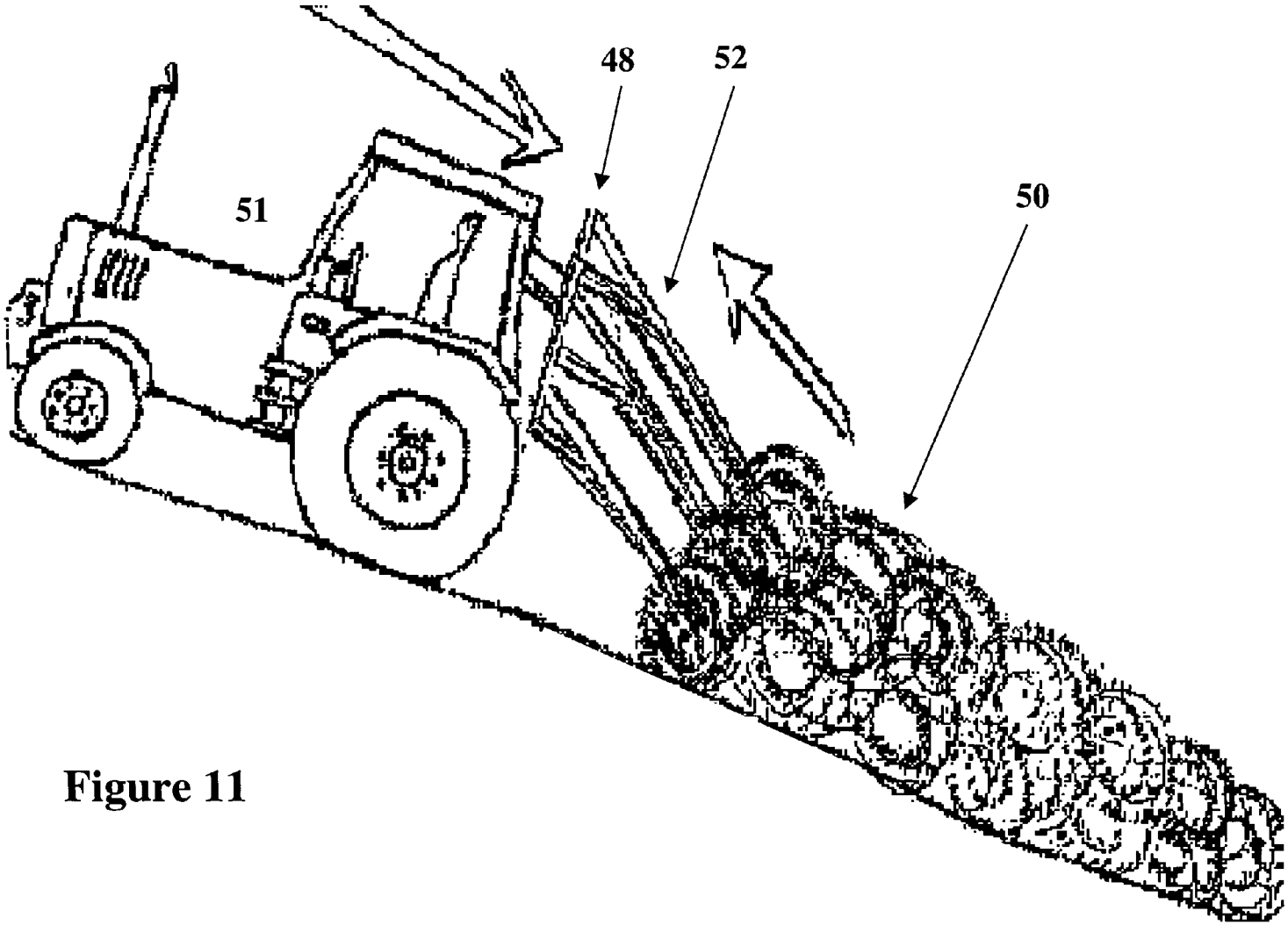
FIG. 11 is a schematic side view of a retrieval operation for a deployed concertina-wire barrier.

Turning now to the retrieval features, by means of example, FIG. 11 illustrates a transport vehicle 51 with the attached deployment rack 48 positioned at one end of the deployed, but unanchored, barrier 50. During retrieval the tines 52 are generally inclined downwards towards their tip as illustrated in FIG. 11. In this manner the tines 52 pass through space roughly defined by the coils as the vehicle advances. Upon commencement, the forward motion causes the coil loops to accumulate on the tines where they are pressed together and pushed towards the tine carry structure FIG. 3 5, thereby preparing them for the next deployment.

It should be noted that the above described loading and retrieval methods apply to both deployment paths in discussion, i.e. paths with a varying gradient and paths distant from an access route.

It will be appreciated that the above descriptions are intended only to serve as examples, and that many other embodiments are possible within the scope of the present invention as defined in the appended claims.

What is claimed is:

1. A method for rapid deployment of concertina-wire barriers comprising:

(a) suspending a compacted concertina-wire coil arrangement on at least one carry tine of a deployment rack support; and (b) actively causing an angle of inclination of said carry tine to change by actuating at least one tilt mechanism during transport in response to a change in path gradient encountered by a deployment vehicle transporting said deployment rack, thereby ensuring progressive deployment reflecting terrain gradients.

2. The method of claim 1 wherein said carry tine is implemented as a platform.

3. A method for loading concertina-wire barriers comprising:

(a) inserting at least one carry tine of a deployment rack into space circumscribed by a compacted concertina-wire coil arrangement;

(b) lifting said deployment rack so as to suspend said compacted concertina-wire coil arrangement from said carry tine; and (c) actively causing an angle of inclination of said carry tine to change by actuating at least one tilt mechanism so as to facilitate progressive deployment of the compacted concertina-wire coil arrangement at a rate reflective of a terrain slope to be encountered by a deployment vehicle transporting said compacted concertina-wire coil arrangement.

4. The method of claim 3 further comprising:

(d) actively causing an angle of inclination of said carry tine to change by way of at least one tilt mechanism during transport in responsive to changes in path gradient encountered along a path on which said deployment rack is being transported so that said coil arrangement is progressively deployed from the transport vehicle at a rate reflecting terrain conditions.

5. A method for retrieving deployed concertina-wire arrangement deployed as a barrier comprising:

(a) advancing at least one carry tine of a deployment rack longitudinally through space circumscribed by a deployed concertina-wire coil arrangement; and (b) actively causing an angle of inclination of said carry tine to change by actuating at least one tilt mechanism during travel responsively to changes in path gradient encountered along a path on which said deployment rack is being transported so that said arrangement is progressively lifted from its deployment location and collected into its compacted, pre-deployment state on said carry tine.

* * * * *